United States Patent [19]

Young

[11] Patent Number: 5,069,311

[45] Date of Patent: Dec. 3, 1991

[54] INFANT EXERCISER GUARD

[76] Inventor: Ferris F. Young, CMR-P Box 1032, Apo, N.Y. 09102

[21] Appl. No.: 534,530

[22] Filed: Jun. 4, 1990

[51] Int. Cl.[5] ..... B60T 3/00

[52] U.S. Cl. ..... 188/32; 272/70.3

[58] Field of Search ..... 272/134, 118, 117; 273/11 R, 8, 9; 188/32; 248/188.2

[56] References Cited

U.S. PATENT DOCUMENTS

| | | | |
|---|---|---|---|
| 1,592,192 | 11/1923 | Evans | 188/32 |
| 1,865,899 | 7/1932 | Gohmann | 248/188.2 |
| 3,720,406 | 3/1973 | Artz | 188/32 |
| 4,743,008 | 5/1988 | Fermaglich | 272/69 |

*Primary Examiner*—V. Millin

*Assistant Examiner*—Jerome Donnelly

*Attorney, Agent, or Firm*—John M. Harrison

[57] ABSTRACT

An infant exerciser guard which includes a stop member having an arcuate or curved contact surface for contacting one or more wheels of an infant exrciser or other wheeled infant carrier or vehicle and preventing the infant carrier or vehicle and infant operator from moving past a predetermined boundary. In a preferred embodiment the infant exerciser guard is secured to the floor by means of fasteners such as screws, suction cups or loop-pile fasteners and in the latter case, an accessory mount plate may be provided in cooperation with the infant exerciser guard for mounting on the floor and receiving the infant exerciser guard in removable relationship.

7 Claims, 1 Drawing Sheet

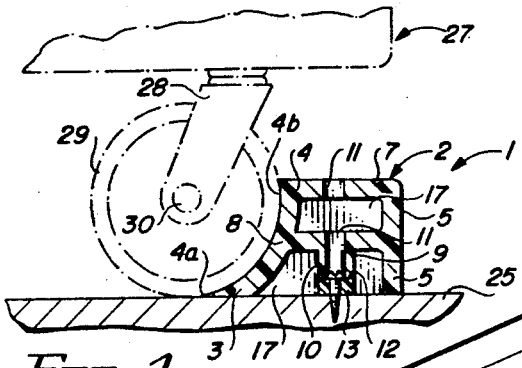
FIG. 1
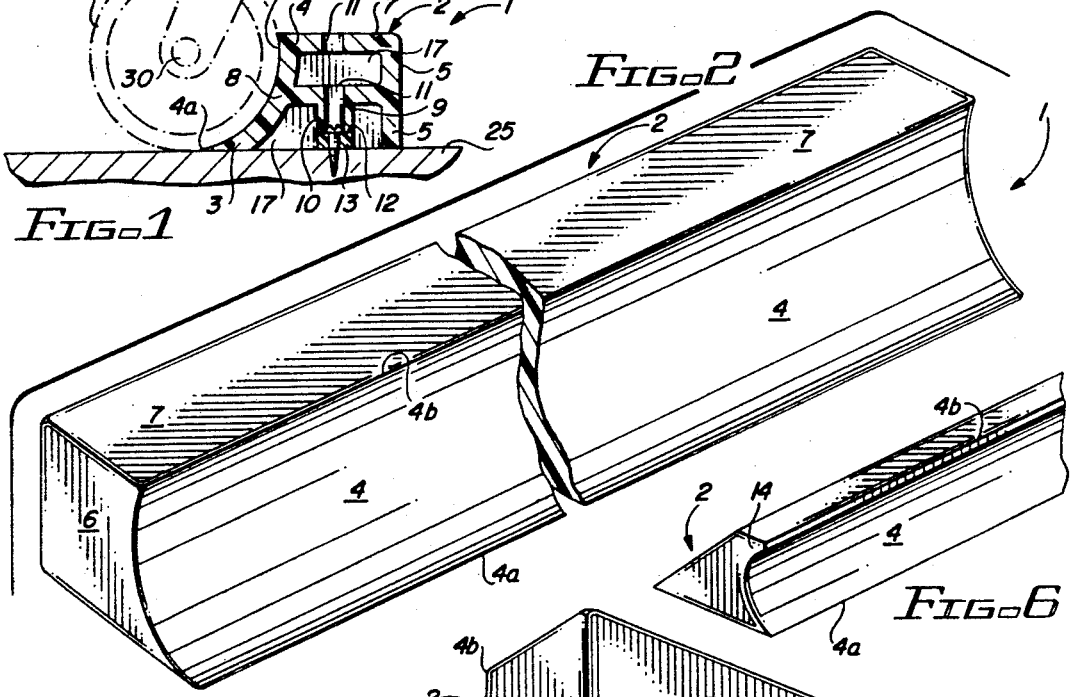
FIG. 2
FIG. 6
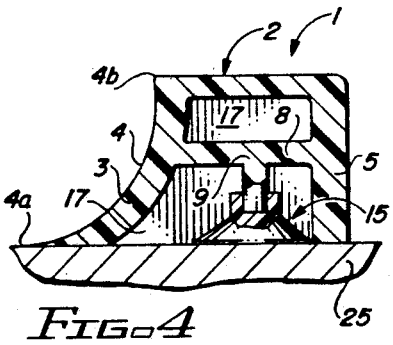
FIG. 4
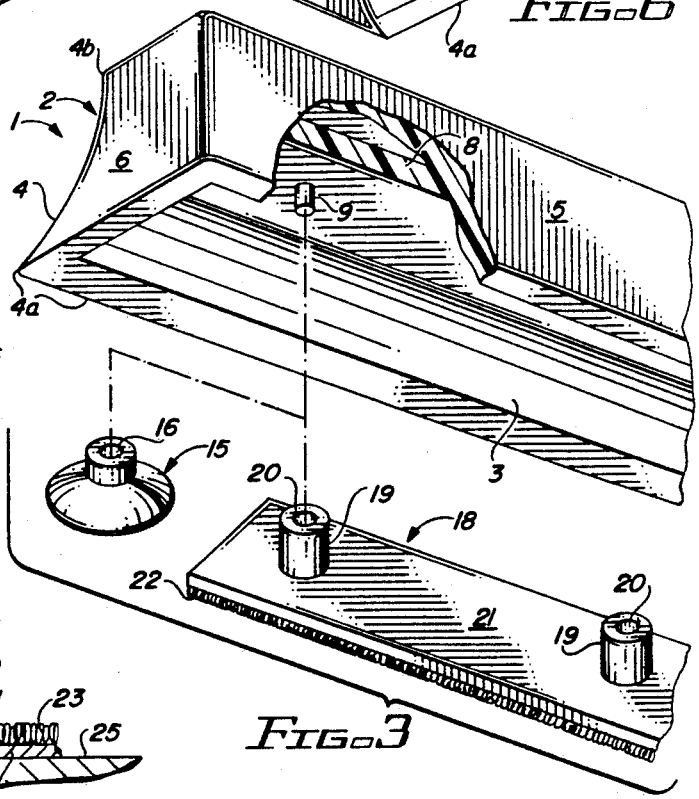
FIG. 3
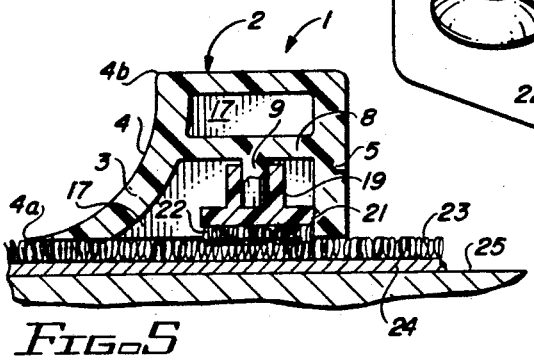
FIG. 5

INFANT EXERCISER GUARD

BACKGROUND OF THE INVENTION

1. Field of the Invention

This invention relates to infant exercisers and more particularly, to an infant exerciser guard which is designed to prevent an infant-operated exerciser or other wheeled vehicle from moving past a predetermined boundary, such as an opening or perimeter. The infant exerciser guard includes one or more stop members located at the entrance, periphery or boundary of an exercise or play area, in order to contact one or more wheels on the infant exerciser, carrier or wheeled vehicle and prevent the infant-operated vehicle from moving past the predetermined position. In a most preferred embodiment the infant exerciser guard is characterized by an elongated stop member secured directly to the floor or other supporting surface and having a concave contact surface which faces the exercising area and substantially matches the contour of the infant exerciser wheels, in order to prevent the wheels and the infant exerciser, as well as the infant operator, from moving past the stop member. In a preferred embodiment the stop member is attached directly to the floor by means of suction cups or other fasteners, including screws and a loop-pile fastener, such as the popular "Velcro" fastener, in non-exclusive particular. In another preferred embodiment of the invention a mount plate is secured to the floor at the opening or boundary perimeter by means of screws or a loop-pile fastener and the stop member is removably attached to the mount plate.

Infant exercisers and other self-propelled vehicles are popular mechanisms for exercising infants and are generally characterized by a frame having a harness or seat suspended therefrom for receiving the infant, and outwardly-extending legs with wheels mounted on the ends of the legs. The infant is placed in the harness with the legs extending to the floor and may move about in any desired direction by leg propulsion, as the wheels roll. One of the problems which exists with such infant exercisers is mobility of the infant into areas which may be dangerous, such as stairs, raised porch and balcony areas and the like. Accordingly, there is a need for an infant exerciser guard which can be quickly and easily installed and operates to positively prevent the infant exerciser and infant from moving past a predetermined boundary, perimeter or point, into a danger zone.

2. Description of the Prior Art

A variation of a typical infant exerciser is detailed in U.S. Pat. No. 4,743,008, dated May 10, 1988, to Daniel R. Fermaglich, et al. The infant exerciser includes a frame adapted for stationary placement on a floor or other supporting surface and a seat and treadmill assembly mounted on the frame. The treadmill is suspended beneath the seat such that an infant supported in the seat can exercise his legs by walking on the treadmill without moving the frame. By revolving the seat and treadmill assembly, the infant can change his or her field of view and interact with the surrounding environment, while simultaneously practicing to walk or otherwise exercising by using of the treadmill.

Other infant exercisers are designed for propulsion by the infant operator and include a frame such as the frame detailed in U.S. Pat. No. 4,743,008, with wheels mounted on the ends of the frame legs and the treadmill removed, to facilitate movement of the infant and the infant exerciser in any direction chosen by the infant.

The infant exerciser guard of this invention is designed to inhibit movement of infant exercisers of this design, as well as other infant carriers and vehicles of any design, past a predetermined opening or perimeter.

Accordingly, it is an object of this invention to provide an infant exerciser guard for mounting in a selected location to prevent an infant located in an infant exerciser, carrier or vehicle from moving past a preselected boundary.

Another object of the invention is to provide an infant exerciser guard which may be removably installed in an opening or around a perimeter, in order to contain an infant located in an infant exerciser, carrier or vehicle in a preselected area.

Another object of this invention is to provide an infant exerciser guard which includes an elongated stop member of selected length having an arcuate or curved wheel contact surface for mounting on a floor and preventing the movement of an infant carrier past a predetermined location.

Still another object of this invention is to provide an infant exerciser guard for containing an infant exerciser or wheeled carrier in a selected exercising area, which infant exerciser guard is characterized by a stop member removably mounted to the floor or other supporting surface at a selected opening or perimeter and having a concave wheel contact surface facing the exercising area for receiving the wheel or wheels of the infant exerciser or carrier and preventing the infant exerciser or carrier and infant from moving past the predetermined opening or perimeter.

Yet another object of the invention is to provide an infant exerciser guard for blocking a selected path of a wheeled infant exerciser, which infant exerciser guard is adapted for mounting directly to the floor or other supporting surface by means of fasteners such as screws, suction cups or loop-pile fasteners.

SUMMARY OF THE INVENTION

These and other objects of the invention are provided in a new and improved infant exerciser guard for containing a wheeled infant exerciser, carrier or vehicle and an infant operator in a predetermined area, which infant exerciser guard includes an elongated stop member having an arcuate, curved or concave wheel contact surface facing the area, which stop member is secured to the floor or to an accessory mount plate attached to the floor in a specified opening or around the perimeter of the exercise area, to contain the infant exerciser, carrier or vehicle by receiving the exerciser, carrier or vehicle wheel or wheels.

BRIEF DESCRIPTION OF THE DRAWING

The invention will be better understood by reference to the accompanying drawing, wherein:

FIG. 1 is a side sectional view of a preferred embodiment of the infant exerciser guard of this invention, illustrating an infant exerciser wheel, (shown in phantom) contacting the infant exerciser guard and detailing a preferred technique for mounting a first preferred infant exerciser guard stop member element directly to a floor;

FIG. 2 is a perspective view, partially in section, of the stop member element of the infant exerciser guard illustrated in FIG. 1;

FIG. 3 is an exploded view of the infant exerciser guard illustrated in FIG. 2, more particularly illustrating a suction cup technique and mount plate embodiment for mounting the infant exerciser guard directly on the floor in one embodiment, and on the mount plate, and the mount plate on the floor, in a second embodiment;

FIG. 4 is a side sectional view of the infant exerciser guard illustrated in FIG. 3, more particularly illustrating the suction cup technique for mounting the stop member directly to the floor;

FIG. 5 is a side sectional view of the infant exerciser guard illustrated in FIG. 3, more particularly illustrating the mount plate technique for mounting the stop member to a mount plate and the mount plate on the floor; and FIG. 6 is a perspective view, partially in section, of an alternative preferred embodiment of the infant exerciser guard of this invention.

DESCRIPTION OF THE PREFERRED EMBODIMENTS

Referring initially to FIGS. 1 and 2 of the drawing, in a first preferred embodiment the infant exerciser guard of this invention is illustrated by reference numeral 1. The infant exerciser guard 1 is characterized by an elongated stop member 2, having a curved front leg 3 which defines an arcuate, concave wheel contact surface 4, terminated at the bottom by a bottom margin 4*a* and at the top by a top margin 4*b*. A top panel 7 joins the curved front leg 3 at the top margin 4*b* and a rear leg 5 extends downwardly from the opposite edge of the top panel 7, as illustrated in FIG. 1. Side panels 6 close opposite sides of the stop member 2 and in a most preferred embodiment, a spacer plate 8 extends between the front leg 3 and the rear leg 5, to define a pair of hollow chambers 17 in the stop member 2. As further illustrated in FIG. 1, aligned access apertures 11 are provided in the top panel 7 and spacer plate 8 and a stud 9 extends downwardly from the spacer plate 8 and includes a stud aperture 10, for receiving a screw 13. The screw 13 seats against a stud shoulder 12, located in the stud aperture 10 and threadably engages the floor 25, in order to removably seat the stop member 2 on the floor 25. Multiple studs 9, access apertures 11 and screws 13 may be provided in spaced relationship in the stop member 2, depending upon the length and configuration of the stop member 2. Accordingly, it will be appreciated from a consideration of FIG. 1 that when the stop member 2 is anchored to the floor 25 by means of one or more screws 13, the wheel 29, rotatably secured to the wheel bracket 28 of an exerciser frame 27 by means of a wheel pin 30, engages the concave wheel contact surface 4, and is effectively prevented from moving past the stop member 2. In a most preferred embodiment of the invention the concave wheel contact surface 4, provided in the curved front leg 3, substantially matches the curvature of the wheel 29, to more positively prevent the exerciser frame 27 from moving past the stop member 2.

Referring now to FIGS. 2–4 of the drawings the stud(s) 9, extending from the spacer plate 8, extends into the stud receptacle 16 of a suction cup 15, which is designed to removably grip the floor 25 without the necessity of using the screw(s) 13, illustrated in FIG. 1. Accordingly, the infant exerciser guard 1 can be relocated at any desired point on the floor 25 using the suction cup 15, without the necessity of driving a screw 13 into the floor 25.

Referring now to FIGS. 3 and 5 of the drawing, in another preferred embodiment of the invention a loop mount 18 is characterized by a flat mount plate 21, provided with the loop element 22 of a loop pile fastener and also fitted with spaced, upward-standing stud cylinders 19, each provided with cylinder openings 20. The cylinder openings 20 of the stud cylinders 19 are designed to receive the respective studs 9, extending in spaced relationship from the spacer plate 8 in the top member 2, in order to secure the stop member 2 to the loop mount 18, as illustrated in FIG. 5. The mount plate 21 of the loop mount 18 is, in turn, secured to corresponding pile elements 23, attached to the floor 25 by means of pile element tape 24, as further illustrated in FIG. 5. This design also facilitates mounting the infant exerciser guard 1 in any desired position on the floor 25 without the necessity of extending the screws 13 into the floor 25.

Referring now to FIG. 6 of the drawing, in another preferred embodiment of the invention the infant exerciser guard is characterized by a stop member 2 which is fitted with an extended concave wheel contact surface 4, defined by a bottom margin 4*a* and a top margin 4*b*, which is longer than the wheel contact surface 4 of the stop member 2 illustrated in FIGS. 1, 2 and 3–5. The top margin 4*b* of the stop member 2 illustrated in FIG. 6 is defined by a lip 14 and the wheel contact surface 4 is designed to receive the wheel 29 in such a manner that it is impossible for the wheel 29 to bounce upwardly over the stop member 2 upon contact with the wheel contact surface 4. Accordingly, the top margin 4*b* and lip 14 are so designed that upward movement of the wheel 29 is prevented and the wheel 29 is constrained to remain on the floor 25, regardless of the force of impact between the wheel 29 and the stop member 2. In a most preferred embodiment of the invention the wheel contact surface 4 in both embodiments is sufficiently long to engage from about one-third to about one-half of the circumference of the wheel 29.

It will be appreciated by those skilled in the art that the infant exerciser guard 1, in both alternative designs, may be constructed of substantially any desired material, including metal such as aluminum and the like, as well as fiberglass and injection-moldable plastic material, such as polyethylene and polypropylene, in non-exclusive particular. The stop member 2 may also be extruded from a plastic material, according to the knowledge of those skilled in the art and may be mounted to guard an opening, such as a doorway, or any desired perimeter of activity, in order to define an exercise or play area of desired size and configuration. Accordingly, the infant exerciser guard can be mounted in doorways, along balconies and porches and at other points of hazard to infants who are highly mobile in a wheeled infant exerciser, carrier or vehicle. Other carriers, including "baby buggies", strollers and the like, whether driven by the infant or not, are also protected. As noted above, the stop member 2 can be mounted directly to the floor or other supporting surface using screws 13, suction cups 15 or a loop-pile fastener 18 containing loop elements 22 for attachment to corresponding pile elements 23, or vice versa, either with or without the loop mount 18, as desired. Other attachment techniques include using carpet tape and glue to secure the stop member 2 in place and multiple units of the stop member 2 may be provided in any desired length and configuration, depending upon the size and shape of the play or exercise area to be protected.

It will be further appreciated by those skilled in the art that the wheel contact surface 4 of the infant exerciser guard 1 may be designed such that regardless of the size of the wheel 29 in the exerciser frame 27, the curvature of the wheel contact surface 4 will prevent the exerciser frame and infant from traversing the stop member 2. Accordingly, the concave wheel contact surface 4 may be designed as illustrated in FIG. 6 with an extended curvature using the lip 14, or it may require less curvature as illustrated in FIGS. 1 and 2, depending upon the design of the infant exerciser, carrier or vehicle to be contained.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A guard for mounting on a floor or other supporting surface and arresting the travel of a wheeled infant carrier, said guard comprising stop means adapted for attachment to the floor or other supporting surface and at least one fastener selected from the group consisting of suction cup fasteners and hook and loop fasteners adapted for engaging said stop means and attaching said stop means to the floor or other supporting surface.

2. The guard of claim 1 further comprising a curved contact surface provided on said stop means for receiving the wheels of the wheeled infant carrier.

3. The guard of claim 2 wherein said curved contact surface substantially conforms to the curvature of the wheels.

4. The guard of claim 3 wherein said curved contact surface is adapted to contact at least about one-third of the circumference of the wheels.

5. The guard of claim 3 wherein said curved contact surface is adapted to contact at least about one-half of the circumference of the wheels.

6. A guard for mounting on a floor or other supporting surface and arresting the travel of a wheeled infant exerciser, said guard comprising an elongated stop member adapted for mounting on a floor or other supporting surface in a selected path of travel of the wheeled infant exerciser; a concave contact surface provided in said stop member, said concave contact surface facing the wheeled infant exerciser for engaging at least one of the wheels of the wheeled infant exerciser; and at least one pair of fasteners selected from the group consisting of suction cups and hook and loop fasteners engaging said stop member for securing said stop member to the floor.

7. An infant exerciser guard for mounting on a floor or other supporting surface and arresting the travel of a wheeled infant exerciser, said infant exerciser guard comprising at least one stop member having a selected length and configuration, said stop member attached to the floor or other surface in a selected path of travel of the wheeled infant exerciser; a concave wheel contact surface provided in said stop member, said wheel contact surface facing the wheeled infant exerciser for engaging at least one of the wheels of the wheeled infant exerciser; and at least one pair of fasteners selected form the group consisting of suction cups and hook and loop fasteners carried by said stop member in spaced relationship for removably securing said stop member to the floor.

* * * * *